US010002499B2

(12) United States Patent
Brönmark et al.

(10) Patent No.: US 10,002,499 B2
(45) Date of Patent: Jun. 19, 2018

(54) DISTRIBUTION OF AUDIBLE NOTIFICATIONS IN A CONTROL ROOM

(71) Applicant: ABB Schweiz AG, Baden (CH)

(72) Inventors: Jonas Brönmark, Västerås (SE); Saad Azhar, Västerås (SE); Veronika Domova, Västerås (SE)

(73) Assignee: ABB Schweiz AG, Baden (CH)

( * ) Notice: Subject to any disclaimer, the term of this patent is extended or adjusted under 35 U.S.C. 154(b) by 0 days. days.

(21) Appl. No.: 15/522,573

(22) PCT Filed: Nov. 27, 2014

(86) PCT No.: PCT/EP2014/075825

§ 371 (c)(1),
(2) Date: Apr. 27, 2017

(87) PCT Pub. No.: WO2016/082881

PCT Pub. Date: Jun. 2, 2016

(65) Prior Publication Data

US 2018/0089965 A1 Mar. 29, 2018

(51) Int. Cl.

| | |
|---|---|
| ***G08B 23/00*** | (2006.01) |
| ***G08B 3/10*** | (2006.01) |
| ***G08B 21/18*** | (2006.01) |
| ***G08B 21/22*** | (2006.01) |

(52) U.S. Cl.
CPC ..... *G08B 3/10* (2013.01); *G08B 21/187* (2013.01); *G08B 21/22* (2013.01)

(58) Field of Classification Search
None
See application file for complete search history.

(56) References Cited

U.S. PATENT DOCUMENTS

| | | | |
|---|---|---|---|
| 2,870,435 | A | 1/1959 | de Graaf |
| 3,098,220 | A | 7/1963 | de Graaf |
| 4,709,330 | A | 11/1987 | Yokoi et al. |

(Continued)

FOREIGN PATENT DOCUMENTS

| | | | |
|---|---|---|---|
| EP | 2212871 | A1 | 8/2010 |
| JP | 2002322117 | A | 11/2002 |
| WO | 2007015639 | A2 | 2/2007 |

OTHER PUBLICATIONS

International Preliminary Report on Patentability Application No. PCT/EP2014/075825 dated Dec. 5, 2016 16 pages.

(Continued)

*Primary Examiner* — Julie Lieu
(74) *Attorney, Agent, or Firm* — Whitmyer IP Group LLC

(57) ABSTRACT

A technology for delivering an audible notification from a process control system in a control room environment, where the delivery is made by one or more first speakers having a first coverage for audible notifications and one or more second speakers having a second coverage for audible notifications. A determination if the location of an operator is covered by the first coverage is made. The audible notification is delivered by the one or more first speakers if it is determined that the location of the operator is covered by the first coverage. The audible notification is delivered by the one or more second speakers if it is determined that the location of the operator is not covered by the first coverage.

18 Claims, 7 Drawing Sheets

(56) References Cited

U.S. PATENT DOCUMENTS

| | | | | |
|---|---|---|---|---|
| 6,329,908 | B1 * | 12/2001 | Frecska | G08B 3/1083 340/384.7 |
| 8,648,709 | B2 | 2/2014 | Gauger et al. | |
| 2005/0114654 | A1 | 5/2005 | Brackett et al. | |
| 2005/0129254 | A1 * | 6/2005 | Connor | H04R 1/403 381/77 |
| 2012/0062383 | A1 | 3/2012 | Bhargva et al. | |
| 2013/0052940 | A1 * | 2/2013 | Brillhart | H04H 40/00 455/3.06 |
| 2016/0005286 | A1 * | 1/2016 | Kiyota | G08B 13/196 340/435 |
| 2016/0187856 | A1 * | 6/2016 | Vilermo | G04G 21/025 340/575 |
| 2017/0124842 | A1 * | 5/2017 | Sinha | G05B 19/048 |

OTHER PUBLICATIONS

International Search Report and Written Opinion of the International Searching Authority Application No. PCT/EP2014/075825 Completed: Jul. 16, 2015; dated Jul. 24, 2015 13 pages.

* cited by examiner

DISTRIBUTION OF AUDIBLE NOTIFICATIONS IN A CONTROL ROOM

TECHNICAL FIELD

The present disclosure relates to distribution of audible notifications in a control room environment. In particular, the disclosure relates to a delivery of an audible notification that depends on the location of an operator.

BACKGROUND

In computer based process control systems, e.g., for controlling manufacturing and process industries, such as chemical plants, oil refineries, pulp and paper mills, steel mills, etc., there is typically a need for monitoring a wide range of control objects. In particular this monitoring typically includes an operator visually examining a user interface, typically presented on one or more computer screens, to identify potential problems with the process control system. It may be difficult for the operator to in an efficient manner acquire continuous feedback of the status of the control objects of the process control system.

In process control systems sound is often used when there is an event or alarm the operator need to acknowledge. That is, sound effects are used to indicate events that have occurred or something else that needs the operator's attention. For example, when an alarm is sounded, the operator may have to look at one or more screens to detect what control object in the process control system the alarm corresponds to.

Operators in control rooms typically spend most of their time at operator workstations. However, they may also perform work away from the workstations. For example, they may lookup blueprint schematics, help a colleague at a different workstation, or go for a cup of coffee in a lunch room. Even though operators are expected to be found at their operator workstations, they can move around.

Operator control rooms often have several operator workstations. To reduce noise level and interference between operator workstations, a known solution is to equip operator workstations with sound showers. A sound shower is a super directed speaker that only an operator sitting or standing at the workstation is able to hear. This reduces the noise level in the control rooms. However, if an operator is not present at his workstation, there is a risk that he will miss a notification that is delivered via the sound shower.

Systems are known where operators are able to manually switch between the sound shower and regular speakers of a control room in order to control where in the control room notifications can be heard. However there is room for improvement of prior art solutions with respect to security in distributing audible notifications to operators.

SUMMARY

It is an object of the present invention to improve the security in distributing notifications in a control room environment. The above object is achieved by the invention according to the independent claims.

A first embodiment concerns a method for delivering an audible notification from a process control system to an operator in a control room environment by one or more first speakers having a first coverage for audible notifications and one or more second speakers having a second coverage for audible notifications. The second coverage is different from the first coverage, and the method comprises: sensing the presence or absence of the operator in one or more zones of the control room environment, and determining if the location of the operator is covered by the first coverage based on the sensing. The method further comprises: delivering the audible notification by the one or more first speakers if it is determined that the location of the operator is covered by the first coverage, and delivering the audible notification by the one or more second speakers if it is determined that the location of the operator is not covered by the first coverage.

The above objects are also achieved by a second embodiment of the invention, which encompasses a system for delivering an audible notification from a process control system to an operator in a control room environment. The system comprises: one or more first speakers having a first coverage for audible notifications, one or more second speakers having a second coverage for audible notifications, wherein the second coverage is different from the first coverage. The system also comprises a detector for sensing the presence or absence of the operator in one or more zones of the control room environment and a processor. The processor is configured to: determine if the location of the operator is covered by first coverage based on a sensing by the detector, deliver the audible notification by the one or more first speakers if it is determined that the location of the operator is covered by the first coverage, and to deliver the audible notification by the one or more second speakers if it is determined that that the location if the operator is not covered by the first coverage.

In a third embodiment of the invention, a computer program product for use in a system comprising: one or more first speakers having a first coverage for audible notifications, one or more second speakers having a second coverage for audible notifications, wherein the second coverage is different from the first coverage, and a detector for sensing the presence or absence of the operator in one or more zones of the control room environment. The computer program product comprises program code instructions which are configured to, when executed on a processor of the system, cause the processor to: determine if the location of the operator is covered by the first coverage based on a sensing by the detector. The computer program further causes the system to: deliver the audible notification by the one or more first speakers if it is determined that the location of the operator is covered by the first coverage, and deliver the audible notification by the one or more second speakers if it is determined that the location of the operator is not covered by the first coverage. The program code instructions may be stored on a non-transitory memory.

In a fourth embodiment of the invention, a workstation for a control room environment comprises one or more first speakers having a speaker coverage configured for delivering an audible notification to an operator that is working at the workstation. The workstation also comprises a detector for sensing the presence or absence of the operator at the workstation. The workstation may be configured to function in the system of the second embodiment mentioned above.

In the above mentioned embodiments the notification may be associated with the operation or status of an automation or process control system. The notification may be an alarm. An alarm is to be understood as a notification to an operator for equipment malfunction, process deviation, or abnormal condition requiring a response of the operator.

The delivery of the audible notification by the one or more second speakers when the location of the operator is not covered by the first coverage contributes to reducing the risk for the operator missing the audible notification. An advantage of the above mentioned embodiments is that it is possible to track and locate the operator and that the notification can be directed to reach the operator.

By implementing the system such that the first coverage of the one or more first speakers is limited to a part of the control room environment and by configuring the system to deliver the audible notification by the one or more first speakers if it is determined that the operator is located within the first coverage the spread of the notification in control room environment is reduced. In control room environments where several operators are working, some audible notifications may be intended primarily for just one operator working at a particular workstation. Such notifications need not be heard in the entire control room environment if the operator for which the notifications are intended is located at the particular workstation. These notifications are only perceivable at other workstations if the operator is not present at the particular workstation. This means that the general noise level in the control room environment is reduced, which also contributes to an improved security in distributing audible notifications. The fact that the notification is an audible notification means that the notification can easily be perceived independent of the orientation of the operator, which also contributes to an improved security in the distribution of notifications. The risk of an operator missing an important notification is reduced, and critical situations can be resolved more efficiently with the proposed method.

The second coverage may be configured to overlap and cover the complete first coverage. This has the effect that if the sensing fails despite the operator being located within the first coverage, the notification will still reach the operator by the one or more second speakers, which contributes to an improved security in the distribution of notifications.

DETAILED DESCRIPTION

The following detailed description of example embodiments refers to the accompanying drawings. The same reference numbers in different drawings identify the same or similar elements. Also, the following detailed description is provided for the purpose of illustration and explanation of some example embodiments and not for the purpose of limitation.

Reference throughout the specification to "one embodiment" or "an embodiment" means that a particular feature, structure, or characteristic described in connection with an embodiment is included in at least one embodiment of this disclosure. Thus, the appearance of the phrases "in one embodiment" or "in an embodiment" in various places throughout the specification are not necessarily all referring to the same embodiment. Further, the particular features, structures or characteristics may be combined in any suitable manner in one or more embodiments.

Figure 1:
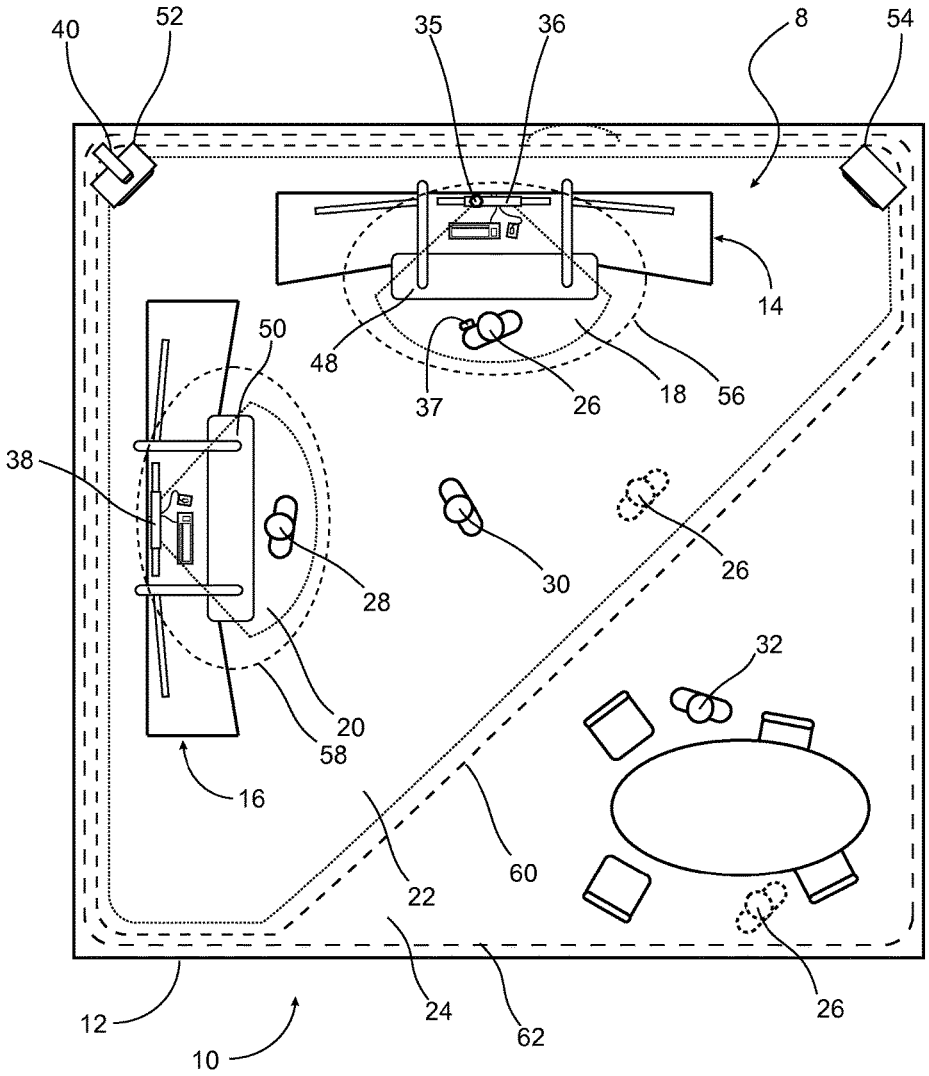
FIG. 1 is a schematic illustration of an embodiment of the invention implemented in a control room environment.

An example of a control room environment 10 is schematically illustrated in FIG. 1. Two workstations 14 and 16 are placed inside a control room 12. The control room 12 is split into several distinctive zones 18, 20, 22, 24. A first zone 18 is where a first operator 26 is located when sitting or working at a first workstation 14. A second zone 20 is where another operator 28 is located when sitting or working at a second workstation 16. A third zone 22 covers a bigger area than the first zone 18 and the second zone 20. A fourth zone 24 covers an even bigger area than the third zone 22 and covers a greater distance from the workstations 14 and 16 than the third zone 22. In the control room environment 10 shown in FIG. 1, the fourth zone is in the control room 12, but in other setups the fourth zone 24 may be in a different room. In FIG. 1 it is schematically illustrated the first operator 26 can move between the different zones. Further operators 30, 32 may also be present in the control room environment 10 as illustrated in FIG. 1.

By knowing in which zone 18, 20, 22, 24 one of the operators 26, 28, 30, 32 is located, it is possible to notify the operator about incoming notifications, such as alarms. According to an example embodiment, if the operator 26 is at the first workstation 14, i.e. in the first zone 18, and notification which is relevant only to the operator 26 at the first workstation 14 comes in, the alarm notification is delivered only in a speaker 48, which in this example is embodied by a sound shower limiting the spread of the alarm to a coverage 56 of the speaker 48, which covers the first zone 18. Thus, no other operator 28, 30, 32 is disturbed in the process, even though there are multiple operator workstations 14, 16 in close vicinity to one another.

By using detectors 36, 38, 40 it is possible to track or determine the location of the operators 26, 28, 30, 32. The detectors have different coverage and may be arranged to sense presence or absence of operators in one or more of the above mentioned zones. A first detector 36 at the first workstation 14 determines if the first operator 26 is located in the first zone 18, i.e. at a "standard" or expected distance from the workstation 14. The operator 26 is detected if the operator is sitting or standing in front of the workstation 14. Similarly, a second detector 38 at the second workstation 16 determines if the second operator 28 is located in the second zone 20. A third detector 40 is located in the control room having a larger coverage which corresponds to the third zone 22 and thus overlapping the coverage of the other two detectors 36, 38. The detector 40 is able to detect the operator 30 in the third zone 22, but not the operator 32 in the fourth zone 24, who is outside its coverage.

If the first operator 26 is detected by the first detector 36, the audible notification, which in this example is an alarm, is delivered by the speaker 48 to the first zone 18, which is delimited by the coverage of the first detector 36. The coverage 56 of the speaker 48 covers the first zone 18. If the first operator 26 is not detected by the first detector 36, but the third detector 40 instead, the alarm is delivered by a speaker 52 to the third zone 22, which is delimited by the coverage of the third detector 40. The speaker 52 is a regular speaker having a coverage 60 that is greater than and covers the coverage 56 of the speaker 48. The coverage 60 of the speaker 52 covers the third zone 22. If the operator is not detected by any of the detectors 36, 38, 40, the alarm is delivered by both the regular speaker 52 and a regular speaker 54 such that the alarm can be heard in the fourth zone 24, which is delimited by a combined coverage 62 of the two speakers 52 and 54 and covers the whole control room environment 10. This way, the alarm will reach the operator 26 if he is present in the fourth zone 24, and it is thus ensured that the operator does not miss the audible notification.

Similar to first operator 26 being detected at the first workstation 14, if the second operator 28 is detected by the second detector 38 in the second zone 20, a notification intended for an operator at the second workstation 16 is delivered by the speaker 50 at the second workstation 16. The speaker at the second workstation 16 has the indicated coverage 58. If the second operator 28 is not detected by the second detector 38 but the third detector 40, the notification is delivered by the speaker 52 to third zone 22. If the operator is not detected by any of the detectors 36, 38, 40, the notification is delivered to the fourth zone 24 by both the regular speaker 52 and the regular speaker 54.

In some embodiments, the same notification may be directed to the operators of both the first workstation 14 and the second workstation 16. If the first operator 26 and the second operator 28 are detected at the first workstation 14 and the second workstation 16, respectively, the notification is delivered to both the first zone 18 and the second zone 20. If only one of the operators 26, 28 is detected at a workstation 14, 16, the notification is directed to that workstation. If none of the operators 26, 28 are detected at their respective workstations 14, 16, the notification is directed to the third zone 22, provided that one of the operators is detected in this zone. If none of the operators 26, 28 are detected in the first zone 18, the second zone 20, or the third zone 22, the notification is instead directed to the fourth zone 24.

If the first operator 26 is not detected by the first detector 36, but the third detector 40 instead, the alarm is delivered by a speaker 52 to the third zone 22, which is delimited by the coverage of the third detector 40. The speaker 52 is a regular speaker having a coverage 60 that is greater than and covers the coverage 56 of the speaker 48. The coverage 60 of the speaker 52 covers the third zone 22. If the operator is not detected by any of the detectors 36, 38, 40, the alarm is delivered by both the regular speaker 52 and a regular speaker 54 such that the alarm can be heard in the fourth zone 24, FIG. 1 is illustrating an example embodiment of a system 8 for delivering an audible notification from a process control system to an operator 26 in a control room environment 10. However other example embodiments of the system than the one illustrated in FIG. 1 are also possible as will become clear from the following description. Still using the reference numerals introduced in FIG. 1, an embodiment of the system 8 generally comprises one or more first speakers 48 that have a first coverage 56 for audible notifications and one or more second speakers 52 and 54 that have a second coverage 60 or 62 for audible notifications. The second coverage 60 or 62 is different from the first coverage 56. The system 8 further comprises a detector 36 for sensing the presence or absence of the operator 26 in one or more zones 18 or 22 of the control room environment 10. The system 8 has a processor configured to determine if the location of the operator 26 is covered by the first coverage 56 based on a sensing by the detector 36. The system 8 is further configured to deliver the audible notification by the one or more first speakers 48 if it is determined that the location of the operator 26 is covered by the first coverage 56, and to deliver the audible notification by the one or more second speakers 52 and 54 if it is determined that that the location if the operator 26 is not covered by the first coverage 56. With this system, the probability of the notification reaching the operator 26 is improved.

The second coverage 60 or 62 may be configured to overlap and cover the complete first coverage 56. This has the effect that if the sensing by the detector 36 fails despite the operator being present within the first coverage, the notification will still reach the operator 26, since the location of the operator is covered by the second coverage 60 or 62 of the one or more second speakers 52 and 54. This contributes to improve the security in the delivery of the notification. Alternatively or additionally, the second coverage 60 or 62 may be configured to cover the complete control room environment 10. This has the effect that the notification can always reach the operator 26, provided the operator remains in the control room environment 10, which also contributes to an improved security in the distribution of notifications.

As illustrated in the example in FIG. 1, the control room environment 10 may comprise a workstation 14 and the first coverage 56 is configured for covering an operator 26 that is active at the workstation 14. Additionally or alternatively, the one or more first speakers 48 may constitute a directional speaker, which is here understood to encompass a sound shower.

The detector 36 may comprise one or more sensors, which may be passive or active. An active sensor requires an operator 26 to carry an identifying device 37, while a passive sensor has no such requirement.

A passive sensor may comprise a pressure plate for being placed under the operator 26 that is working at the work station 14. Simple sensors, for example infrared proximity sensor, ultrasonic proximity sensor, and heat sensors may be used to determine if the operator 26 is located in a particular coverage 56. Advanced passive sensors, such as a Microsoft Kinect®, could be used to locate how far the operator 26 is from the workstation 14 and to determine biometric features of the operator 26. The Kinect® may use a variety of sensors, such as RGB and infrared cameras in combination to determine the location of the operator 26.

An active sensor may involve Radio-Frequency IDentification (RFID) technology, BlueTooth (BT) technology, Wireless Local Area Network (WLAN) technology, Near Field Communication (NFC), IBeacons, and Smartphones or other wearable. The sensing of the presence or absence of the operator may be determined by magnetic field measurements or inertial measurements, or may involve a radio/electromagnetic measuring device.

In one embodiment, the system may comprise an identification device 37 as illustrated in FIG. 1 configured to be carried by the operator 26. The detector 36 may comprise a control device 35 configured to cooperate with the identification device 37 to determine the identity of the identification device 37. The identification device 37 may comprise a transmitter, e.g. a radio or IR transmitter, for sending an identifying signal, and the control device 35 may have a receiver for receiving the identifying signal. The system may be configured to determine if the location of the operator 26 is covered by the first coverage 56 based on the signal. The detector coverage may then be defined by the strength of the signal transmitted from the transmitter 37 and the sensitivity of the receiver 35 for receiving the signal. The active signal from the operator may e.g. be generated by means of BT, WLAN, or NFC technology.

In some embodiments the detector 36 is configured to sense presence or absence of the operator in a first zone 18 of the one or more zones and the first coverage 56 is configured to overlap and cover the complete first zone 18. The system 8 is further configured to determine if the location of the operator 26 is covered by the first coverage 56 based on the sensing of the presence or absence of the operator 26 in the first zone 18. This has the effect that if the operator 26 is sensed in the first zone 18, the notification will always reach the operator by the one or more first speakers 48. If the detector 36 instead would be configured have a greater coverage than the one or more first speakers 48, there would be a risk that the notification is be delivered by the one or more first speakers 48, even though the operator 26 is located outside the first coverage 56. This may result in the operator 26 not receiving the notification, which is avoided in the present case where the first coverage 56 overlaps the complete first zone 18 in which the detector senses a presence or absence of the operator.

In some embodiments, the detector 36 may be configured to determine the identity of the individual operator 26, and the system 8 may further be configured to determine if the location of the operator 26 is covered by the first coverage 56 based on the determined identity. This has the effect that that the notification can be directed to the location of a specific operator 26, and those not intended as recipients of the alarm in other zones will not be disturbed by the notification. This has the advantage of a more secure delivery of the notification and a reduced noise in the control room environment 10.

The detector 36 may be configured to receive a signal from the individual operator 26 identifying the individual operator 26 and to determine the identity based on the signal. This has the effect of a reduced risk for misidentification of the operator 26, which improves the security in distributing notifications in the control room environment 10. The system may comprise a transmitter 37 as described above, but configured to transmit the signal identifying the individual operator 26. Similarly, the receiver 35 may be configured to receive the signal the signal identifying the individual operator 26. The detector coverage may be defined as above, and the signal may involve the technology listed above.

Additionally or alternatively, the detector 36 may be configured to determine one or more biometric features of the operator 26 and to determine the identity based on the determined biometric feature. This means that the identity can be determined passively and the operator 26 does not need to carry any identifying device 37, thus reducing the number of components the system 8 depends on for identifying an operator 26, which contributes to improving the security in distributing notifications. For example, the operator 26 may forget to bring with him the identifying device 37, which could lead to the signal being delivered by the wrong speaker, or not at all. The one or more biometric feature may comprise physiological characteristics, such as facial features, hand geometry, and iris patterns. Additionally or alternatively, the one or more biometric feature may comprise behavioral characteristics, such as gait and movement patterns.

Figure 2B:
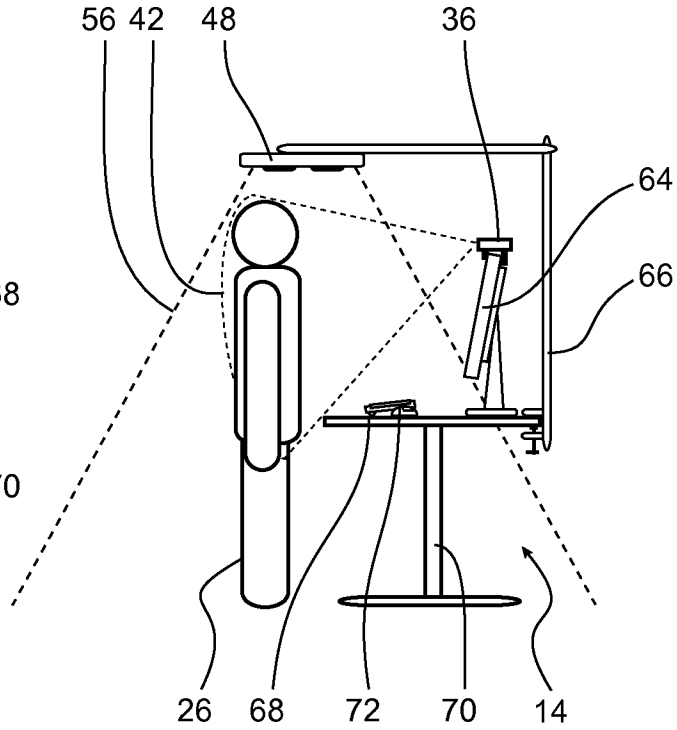
FIGS. 2*a*-2*b* are views of an embodiment of a workstation.
Figure 2A:
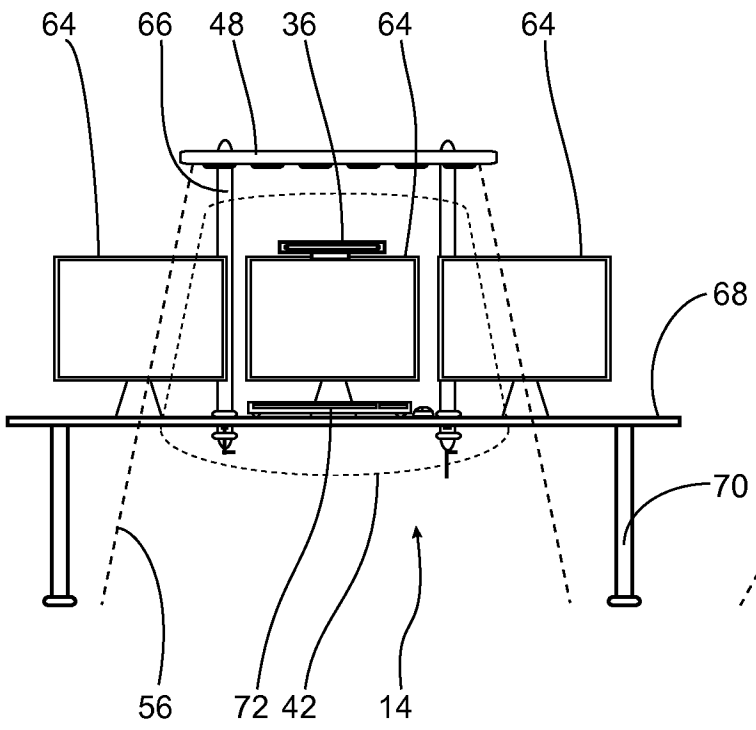

An embodiment of a workstation 14 for a control room environment 10 is illustrated in FIGS. 2*a-b*. FIG. 2*a* is a front view of the workstation 14, and FIG. 2*b* is a side view. The workstation 14 may be configured to function in the system described in relation to FIG. 1. The workstation 14 comprises one or more first speakers 48 having a speaker coverage 56 configured for delivering an audible notifications to an operator 26 that is working at the workstation 14. The workstation also comprises a detector 36 for sensing the presence or absence of the operator 26 at the workstation 14. The detector 36 may have a detector coverage 42 in which the operator 26 can be detected, and the speaker coverage 56 may be overlapping and covering the detector coverage 42. The one or more first speakers 48 may constitute a directional speaker placed above the operator 26 working at the workstation 14. The detector 36 may comprise a proximity sensor and/or a motion sensor for sensing the presence of the operator 26, and/or a biometric sensor for determining one or more biometric feature of the operator 26.

In the embodiment shown in FIGS. 2*a-b*, the detector 36 is attached to the top of a monitor 64 standing on a table top 68. The table top 68 is standing on a pair of legs 70. The directional speaker 48 is supported by a speaker support 66 attached to the table top 68. Input means 72, e.g. a keyboard and a mouse for enabling input to a process control systems, may be placed on the table top 68.

Figure 3A:
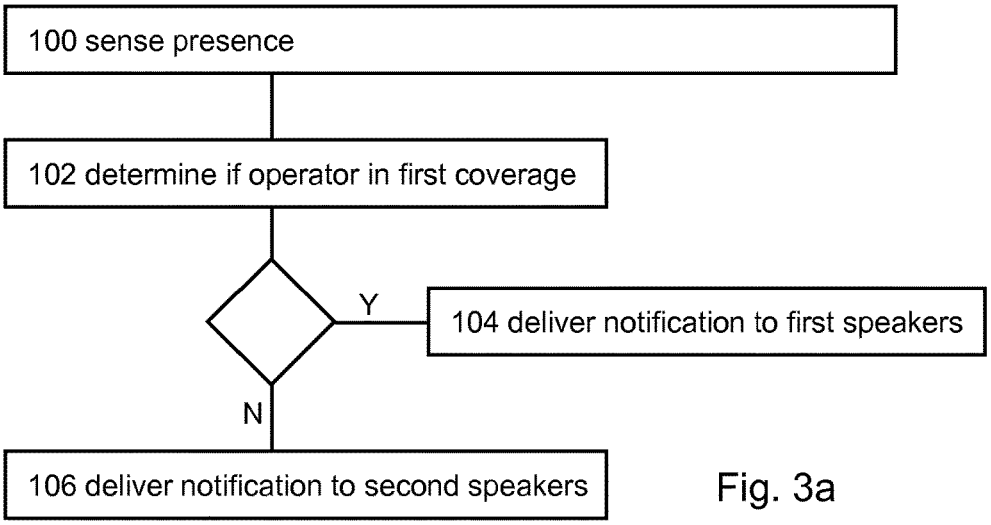
FIGS. 3*a*-3*c* are flow charts illustrating the steps performed in an embodiment of the invention.

A method for delivering an audible notification from a process control system to an operator in a control room environment is illustrated in FIG. 3*a*. The audible notification can be delivered by one or more first speakers or one or more second speakers. The one or more first speakers has a first coverage for audible notifications and one or more second speakers has a different second coverage for audible notifications. The method comprises the steps:

- sensing 100 the presence or absence of the operator in one or more zones of the control room environment,
- determining 102 if the location of the operator is covered by the first coverage based on the sensing,
- delivering 104 the audible notification by the one or more first speakers 48 if it is determined that the location of the operator is covered by the first coverage, and
- delivering 106 the audible notification by the one or more second speakers 52 and 54 if it is determined that the location of the operator is not covered by the first coverage.

Figure 3B:
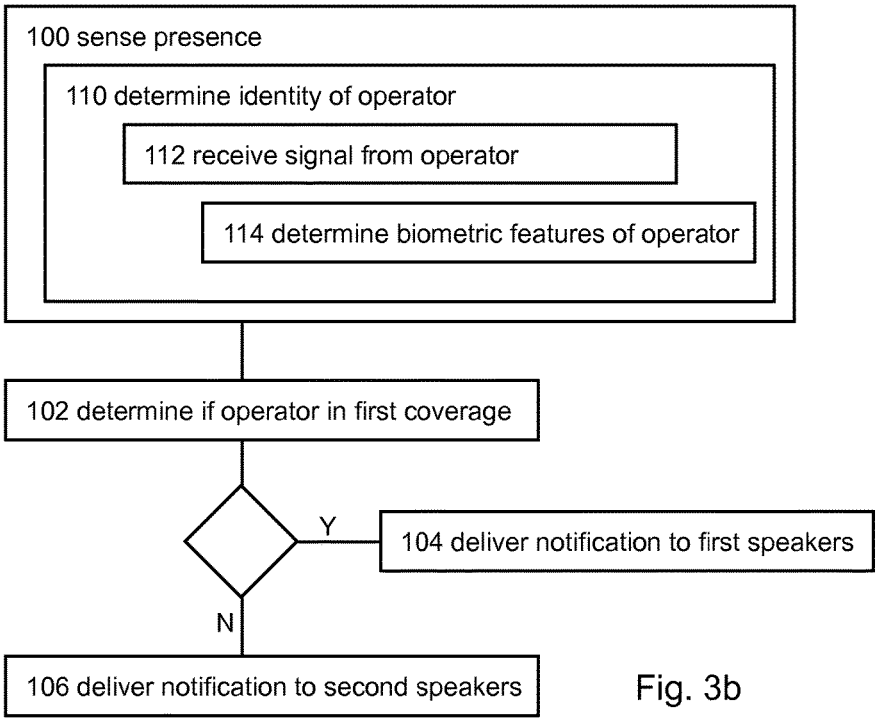

In an alternative embodiment illustrated in FIG. 3*b*, the step of sensing 100 the presence or absence of the operator in one or more zones may optionally comprise:

- determining 110 the identity of the individual operator.

Additionally, the step of determining 110 the identity of the individual operator may comprise:

- receiving 112 a signal from the individual operator configured to identify the individual operator, and
- determining 110 the identity based on the signal.

Additionally or alternatively, the step of determining 110 the identity of the individual operator may comprise:

- determining 114 one or more biometric features of the operator, and
- determining 110 the identity based on the determined biometric feature.

Figure 3C:
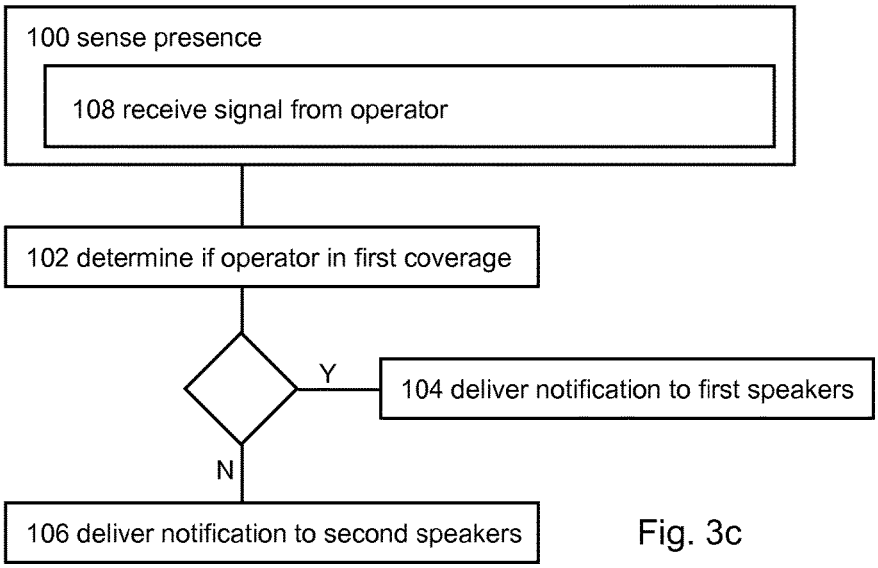

In an alternative embodiment illustrated in FIG. 3*c*, the step of sensing 100 the presence or absence of the operator in one or more zones instead comprises:

- receiving 108 a signal from an operator, and
- the determination 102 if the location of the operator is covered by the first coverage is based on the signal.

Figure 4:
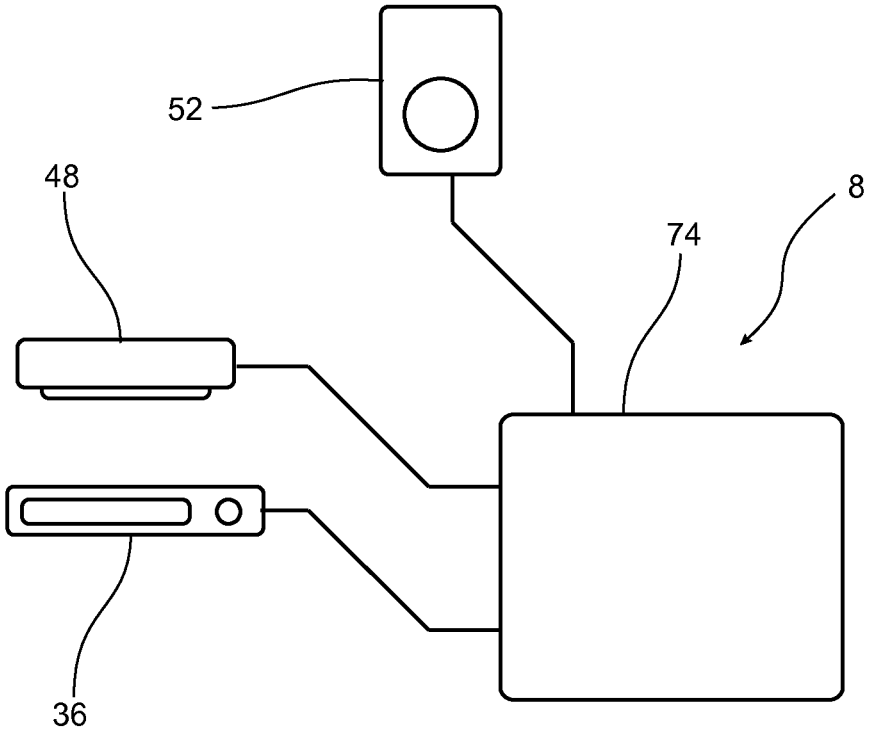
FIG. 4 is a schematic illustration of an embodiment of a system.

FIG. 4 is a schematic illustration of an embodiment of a system 8 for delivering an audible notification from a process control system in a control room environment. The system 8 comprises one or more first speakers 48 having a first coverage for audible notifications and one or more second speakers 52 having a second coverage for audible notifications. The second coverage is different from the first coverage. The system 8 comprises a processor 74 configured to execute the method described above in relation to FIGS. 3*a-c*.

Figure 5:
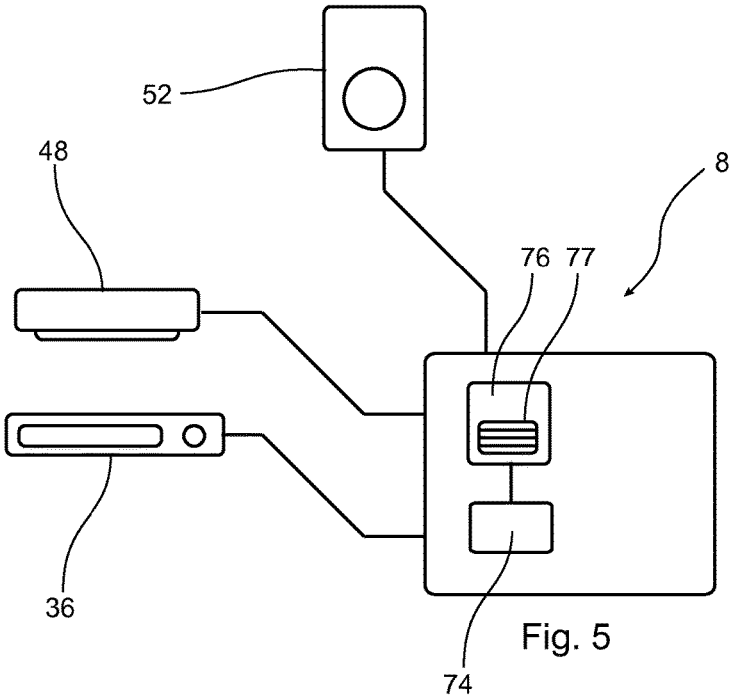
FIG. 5 is another schematic illustration of an embodiment of a system.

FIG. 5 is a schematic illustration of another embodiment of a system 8 for delivering an audible notification from a process control system in a control room environment. The system 8 comprises one or more first speakers 48 having a first coverage for audible notifications and one or more second speakers 52 having a second coverage for audible notifications, wherein the second coverage is different from the first coverage. The system 8 further comprises a detector 36 for sensing the presence or absence of the operator in one or more zones of the control room environment, a processor 74 and a memory 76.

Figure 6:
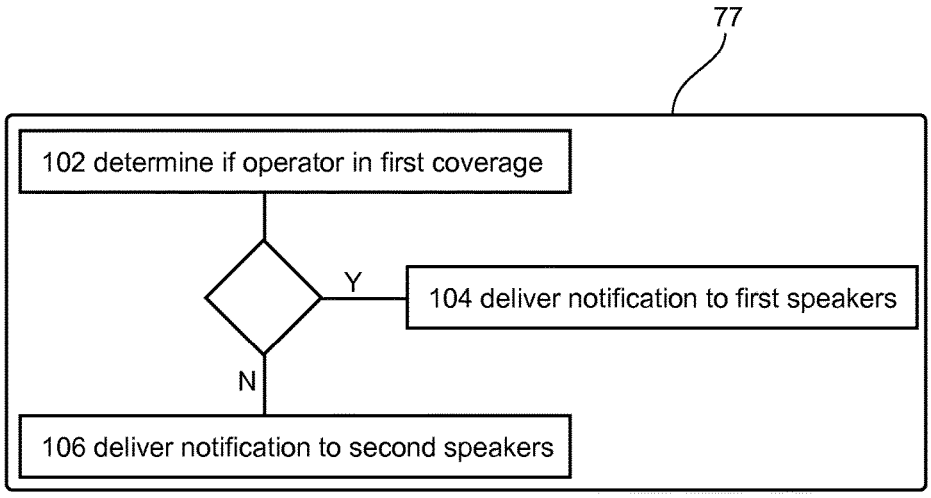
FIG. 6 is a schematic illustration of a computer program product.

In one embodiment, the memory 76 is a non-transitory memory containing a computer program product 77. With reference to FIG. 6, the computer program product 77 is configured to, when executed on the processor 74 of the system 8, cause the processor 74 to:

determine 102 if the location of the operator is covered by the first coverage based on a sensing by the detector 36, deliver 104 an audible notification by the one or more first speakers 48 if it is determined that the location of the operator is covered by the first coverage, and deliver the audible notification by the one or more second speakers 52 if it is determined that the location of the operator is not covered by the first coverage.

The code instructions may further be configured to cause the processor 74 to perform any of the steps described in relation FIGS. 3*a-c*.

The processor 74 described in relation to FIGS. 4 and 5 may be a processor that is dedicated for the described function. Alternatively, the processor may be a general purpose processor, which may be integrated with the process control system. A processor is here understood to encompass a single physical processing unit that individually handles a process, or a group of physical processing units that cooperate to handle a process.

Figure 7:
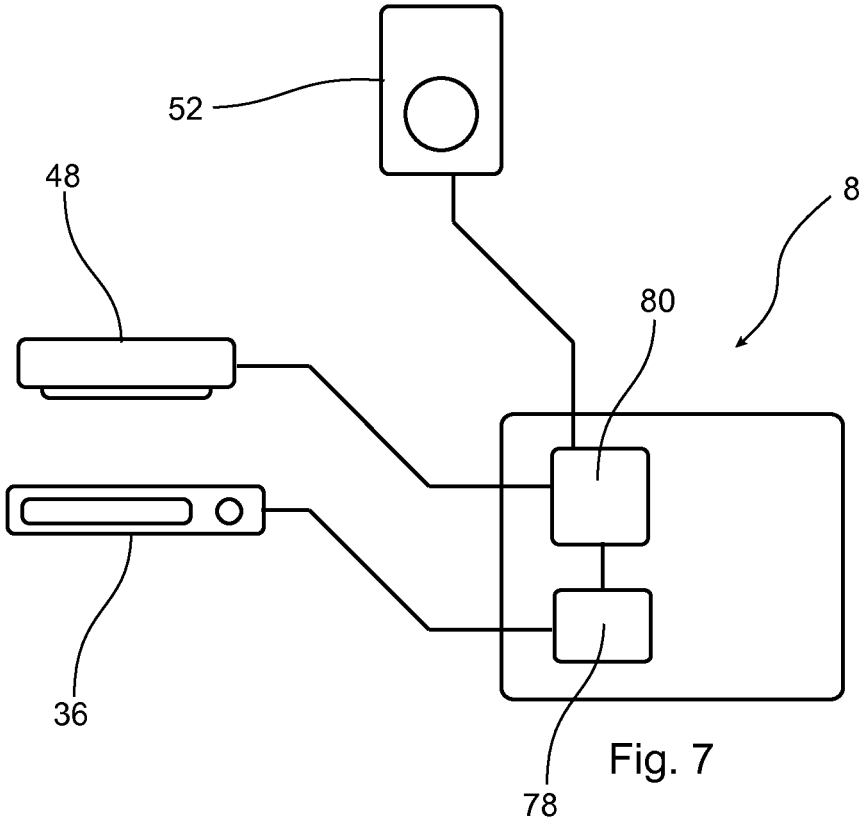
FIG. 7 is yet another schematic illustration of an embodiment of a system.

FIG. 7 is a schematic illustration of yet another embodiment of a system 8 for delivering an audible notification from a process control system in a control room environment. The system 8 comprises one or more first speakers 48 having a first coverage for audible notifications and one or more second speakers 52 having a second coverage for audible notifications, wherein the second coverage is different from the first coverage. The system 8 further comprises a detector 36 for sensing the presence or absence of the operator in one or more zones of the control room environment, a determining module 78 adapted to determine if the location of the operator is covered by the first coverage based on a sensing by the detector, and a control module 80 adapted to deliver the audible notification by the one or more first speakers 48 if it is determined that the location of the operator is covered by the first coverage, and to deliver the audible notification by the one or more second speakers 52 if it is determined that that the location if the operator is not covered by the first coverage.

The systems 8 described in relation to FIG. 7 may comprise further modules adapted to have the functions and operate under the conditions described in relation to FIG. 1. Additionally or alternatively, the systems 8 described in relation to FIG. 7 may comprise further modules adapted to perform any of the steps of the method described in relation to FIG. 3*a-c*. The system 8 may also be configured or operate under the conditions described in relation to FIG. 3*a-c*. Each module may be may be implemented in software, firmware and/or hardware.

In the embodiments described in relation to FIGS. 4-7, the second coverage may be configured to overlap and cover the complete first coverage. Additionally or alternatively, the second coverage may be configured to cover the complete control room environment. Further, the control room environment may comprise a workstation, e.g. as described in relation to FIGS. 2*a-b*, and the first coverage may be configured to cover an operator that is active at the workstation. The one or more first speakers 48 may constitute a directional speaker.

The one or more zones may comprise a first zone and the first coverage may be configured to overlap and cover the complete first zone. The step of determining if the location of the operator is covered by the first coverage may be based on the sensing of the presence or absence of the operator in the first zone.

In the drawings and specification, there have been disclosed typical embodiments and, although specific terms are employed, they are used in a generic and descriptive sense only and not for purposes of limitation, the scope of the invention being set forth in the following claims.

The invention claimed is:

1. A method for delivering an audible notification from a process control system to an operator in a control room environment by one or more first speakers having a first coverage for audible notifications and one or more second speakers having a second coverage for audible notifications, wherein the one or more first speakers constitute a directional speaker, the second coverage is different from the first coverage and configured to overlap and cover the complete first coverage, and wherein the audible notification is an alarm, the method comprises:

sensing the presence or absence of the operator in one or more zones of the control room environment, determining if the location of the operator is covered by the first coverage based on the sensing, delivering the audible notification by the one or more first speakers if it is determined that the location of the operator is covered by the first coverage, and delivering the audible notification by the one or more second speakers if it is determined that the location of the operator is not covered by the first coverage.

2. The method according to claim 1, wherein the alarm is associated with the operation or status of an automation or process control system, and wherein the alarm is a notification to the operator for equipment malfunction, process deviation, or abnormal condition requiring a response of the operator.

3. The method according to claim 1, wherein the second coverage is configured to cover the complete control room environment.

4. The method according to claim 1, wherein the control room environment comprises a workstation and the first coverage is configured to cover an operator that is active at the workstation.

5. The method according to claim 1, wherein the one or more zones comprises a first zone and the first coverage is configured to overlap and cover the complete first zone, and the step of determining if the location of the operator is covered by the first coverage is based on the sensing of the presence or absence of the operator in the first zone.

6. The method according to claim 1, wherein the step of sensing the presence or absence of the operator in one or more zones comprises:

determining the identity of the individual operator.

7. The method according to claim 6, wherein the step of determining the identity of the individual operator comprises:

receiving a signal from the individual operator configured to identify the individual operator, and determining the identity based on the signal.

8. The method according to claim 6, wherein the step of determining the identity of the individual operator comprises:

determining one or more biometric features of the operator, and determining the identity based on the determined biometric feature.

9. A system for delivering an audible notification from a process control system to an operator in a control room environment, wherein the audible notification is an alarm, the system comprises:

one or more first speakers having a first coverage for audible notifications, wherein the one or more first speakers constitute a directional speaker, one or more second speakers having a second coverage for audible notifications, wherein the second coverage is different from the first coverage and configured to overlap and cover the complete first coverage, a detector for sensing the presence or absence of the operator in one or more zones of the control room environment, and a processor configured to:

determine if the location of the operator is covered by the first coverage (56) based on a sensing by the detector, deliver the audible notification by the one or more first speakers if it is determined that the location of the operator is covered by the first coverage, and to deliver the audible notification by the one or more second speakers if it is determined that that the location if the operator is not covered by the first coverage.

10. The system according to claim 9, wherein the alarm is associated with the operation or status of an automation or process control system, and wherein the alarm is a notification to the operator for equipment malfunction, process deviation, or abnormal condition requiring a response of the operator.

11. The system according to claim 9, wherein the second coverage is configured to cover the complete control room environment.

12. The system according to claim 9, wherein the control room environment comprises a workstation and the first coverage is configured for covering an operator that is active at the workstation.

13. The system according to claim 9 wherein the detector is configured to sense presence or absence of the operator in a first zone, the first coverage is configured to overlap and cover the complete first zone, and the system is configured to:

determine that the location of the operator is covered by the first coverage if the detector senses the presence of the operator in the first zone.

14. The system according to claim 9, wherein the detector is configured to determine the identity of the individual operator, and the system is further configured to:

determine if the location of the operator is covered by the first coverage based on the determined identity.

15. The system according to claim 14, wherein the detector is configured to:

receive a signal from the individual operator identifying the individual operator and to determine the identity based on the signal.

16. The system according to claim 14, wherein the detector is configured to:

determine one or more biometric feature of the operator and to determine the identity based on the determined biometric feature.

17. A computer program product for use in a system comprising one or more first speakers having a first coverage for audible notifications, one or more second speakers having a second coverage for audible notifications, wherein the second coverage is different from the first coverage and configured to overlap and cover the complete first coverage, and a detector for sensing the presence or absence of the operator in one or more zones of the control room environment, wherein the one or more first speakers constitute a directional speaker and the audible notification is an alarm, the computer program product comprising program code instructions configured to, when executed by a processor of the system, cause the processor to:

determine if the location of the operator is covered by the first coverage based on a sensing by the detector, deliver an audible notification by the one or more first speakers if it is determined that the location of the operator is covered by the first coverage, and deliver the audible notification by the one or more second speakers if it is determined that the location of the operator is not covered by the first coverage.

18. The computer program product according to claim 17, wherein the alarm is associated with the operation or status of an automation or process control system, and wherein the alarm is a notification to the operator for equipment malfunction, process deviation, or abnormal condition requiring a response of the operator.

* * * * *